US005408172A

United States Patent [19]

Tanimoto et al.

[11] Patent Number: 5,408,172

[45] Date of Patent: Apr. 18, 1995

[54] STEP-DOWN CIRCUIT FOR POWER SUPPLY VOLTAGE CAPABLE OF MAKING A QUICK RESPONSE TO AN INCREASE IN LOAD CURRENT

[75] Inventors: Junichi Tanimoto, Ikoma; Toshiji Ishii, Sakurai, both of Japan

[73] Assignee: Sharp Kabushiki Kaisha, Osaka, Japan

[21] Appl. No.: 105,936

[22] Filed: Aug. 13, 1993

[30] Foreign Application Priority Data

Nov. 25, 1992 [JP] Japan ..... 4-314544

[51] Int. Cl.[6] ..... G05F 1/445

[52] U.S. Cl. ..... 323/273; 323/280; 323/281; 323/349

[58] Field of Search ..... 323/273, 274, 275, 280, 323/281, 277, 349

[56] References Cited

U.S. PATENT DOCUMENTS

| | | | |
|---|---|---|---|
| 4,593,338 | 6/1986 | Takada et al. | 323/275 X |
| 4,958,121 | 9/1990 | Cuomo et al. | 323/224 |
| 5,023,541 | 6/1991 | Yosinski | 323/275 |
| 5,309,082 | 5/1994 | Payne | 323/273 X |

FOREIGN PATENT DOCUMENTS 3228285 10/1991 Japan .

*Primary Examiner*—A. D. Pellinen
*Assistant Examiner*—Y. J. Han

[57] ABSTRACT

A step-down circuit for power supply voltage, which converts an external power supply voltage into a first voltage that is lower than the external power supply voltage so as to apply it to an internal circuit, is provided with: a reference voltage generation circuit for generating a reference voltage from an external power supply voltage, a differential amplification circuit for releasing a difference between the reference voltage and the first voltage as a control signal, a driving circuit for controlling a driving current to be supplied to the internal circuit according to the control signal from the differential amplification circuit, a signal generation circuit for releasing a detection signal by detecting an increase of consumption current in the internal circuit, and a control means for controlling the driving circuit so as to increase the current to be supplied to the internal circuit in accordance with the detection signal from the signal generation circuit. Even if the consumption current of the internal circuit increases, this arrangement makes it possible to restrict the drop of the first voltage to be applied to the internal circuit to a minimum value.

6 Claims, 4 Drawing Sheets

STEP-DOWN CIRCUIT FOR POWER SUPPLY VOLTAGE CAPABLE OF MAKING A QUICK RESPONSE TO AN INCREASE IN LOAD CURRENT

FIELD OF THE INVENTION

The present invention relates to a step-down circuit for power supply voltage which reduces an external power supply voltage to a predetermined voltage.

BACKGROUND OF THE INVENTION

FIG. 5 shows a conventional step-down circuit for power supply voltage. The step-down circuit for power supply voltage is provided with a reference voltage generation circuit 14 for generating a reference voltage $V_{REF}$ from an external power supply voltage $V_{CC}$, a differential amplification circuit 11 to which the reference voltage $V_{REF}$ and a power supply voltage $V_{INT}$ for use in an internal circuit 13 are inputted, and a driving circuit 12 for controlling a driving current $I_{INT}$ for the internal circuit 13 by receiving a control signal $V_{OPO}$ that is an output of the differential amplification circuit 11. A P-channel MOSFET is employed as the driving circuit 12.

Upon activating the internal circuit 13, as the power consumption of the internal circuit 13 (that is, the driving current $I_{INT}$) increases, the power supply voltage $V_{INT}$ of the internal circuit 13 decreases. In this case, the control signal $V_{OPO}$ released from the differential amplification circuit 11 goes low, thereby turning on the driving circuit 12 (P-channel MOSFET). As a result, since the driving current $I_{INT}$ is supplied to the internal circuit 13, the power supply voltage $V_{INT}$ of the internal circuit 13 increases.

When the power supply voltage $V_{INT}$ of the internal circuit 13 keeps on increasing and exceeds the reference voltage $V_{REF}$, the control signal $V_{OPO}$ from the differential amplification circuit 11 goes high, thereby turning off the driving circuit 12 (P-channel MOSFET). As a result, since the driving current $I_{INT}$ is no longer supplied to the internal circuit 13, the power supply voltage $V_{INT}$ stops increasing at the time when the power supply voltage $V_{INT}$ becomes equivalent to the reference voltage $V_{REF}$.

As described above, the power supply voltage $V_{INT}$ of the internal circuit 13 is returned to the reference voltage $V_{REF}$ by controlling the driving circuit 12 for the internal circuit 13 by the use of the control signal $V_{OPO}$ that is obtained by detecting and amplifying a difference between the power supply voltage $V_{INT}$ and the reference voltage $V_{REF}$ by the use of the differential amplification circuit 11. Thus, the power supply voltage $V_{INT}$ of the internal circuit 13 is set at the reference voltage $V_{REF}$ that is lower than the external power supply voltage $V_{CC}$.

However, in such an arrangement wherein the difference between the power supply voltage $V_{INT}$ and the reference voltage $V_{REF}$ is amplified by the differential amplification circuit 11, there has arisen a problem that in the event of a drastic change in the consumption current of the internal circuit 13 as is illustrated in FIG. 6(*b*) it takes some time (during time $t_2$ in FIG. 6(*a*)) for the control signal $V_{POP}$ from the differential amplification circuit 11 to go low. For this reason, during this period of time the power supply voltage $V_{INT}$ drops to a substantial degree from the reference voltage $V_{REF}$ (as indicated by $\Delta V_2$ in FIG. 6(*a*)). Consequently, this causes an adverse effect on high-speed operation of the internal circuit 13 that is constituted of a device such as a semiconductor integrated circuit.

SUMMARY OF THE INVENTION

It is a primary objective of the present invention to provide a step-down circuit for power supply voltage which readily deals with an increase of consumption current in a short period of time.

In order to achieve the above objective, the step-down circuit for power supply voltage, which converts-an external power supply voltage into a first voltage that is lower than the external power supply voltage so as to apply it to an internal circuit, is constituted of: a reference voltage generation circuit for generating a reference voltage from an external power supply voltage, a differential amplification circuit for releasing a difference between the reference voltage and the first voltage as a control signal, a driving circuit for controlling a driving current to be supplied to the internal circuit according to the control signal from the differential amplification circuit, a signal generation circuit for releasing a detection signal by detecting an increase of consumption current in the internal circuit, and a control means for controlling the driving circuit so as to increase the current to be supplied to the internal circuit in accordance with the detection signal from the signal generation circuit.

With this configuration, even if the consumption current of the internal circuit increases, the drop of the first voltage to be applied to the internal circuit can be restricted to a minimum value.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a circuit diagram of a step-down circuit for power supply voltage.

FIG. 2 is a circuit diagram showing one example of an active-signal generation circuit in the step-down circuit for power supply voltage of FIG. 1.

FIG. 3 is a circuit diagram showing another example of an active-signal generation circuit in the step-down circuit for power supply voltage of FIG. 1.

FIG. 4(*a*) illustrates voltage waveforms in the step-down circuit for the power supply voltage of FIG. 1.

FIG. 4(*b*) illustrates current waveforms in the step-down circuit for the power supply voltage of FIG. 1.

FIG. 6(*b*) illustrates current waveforms in the step-down circuit for the power supply voltage of FIG. 5.

DESCRIPTION OF THE EMBODIMENTS

Referring to FIGS. 1 to 3, 4(*a*) and 4(*b*) the following description will discuss one embodiment of the present invention.

Figure 1:
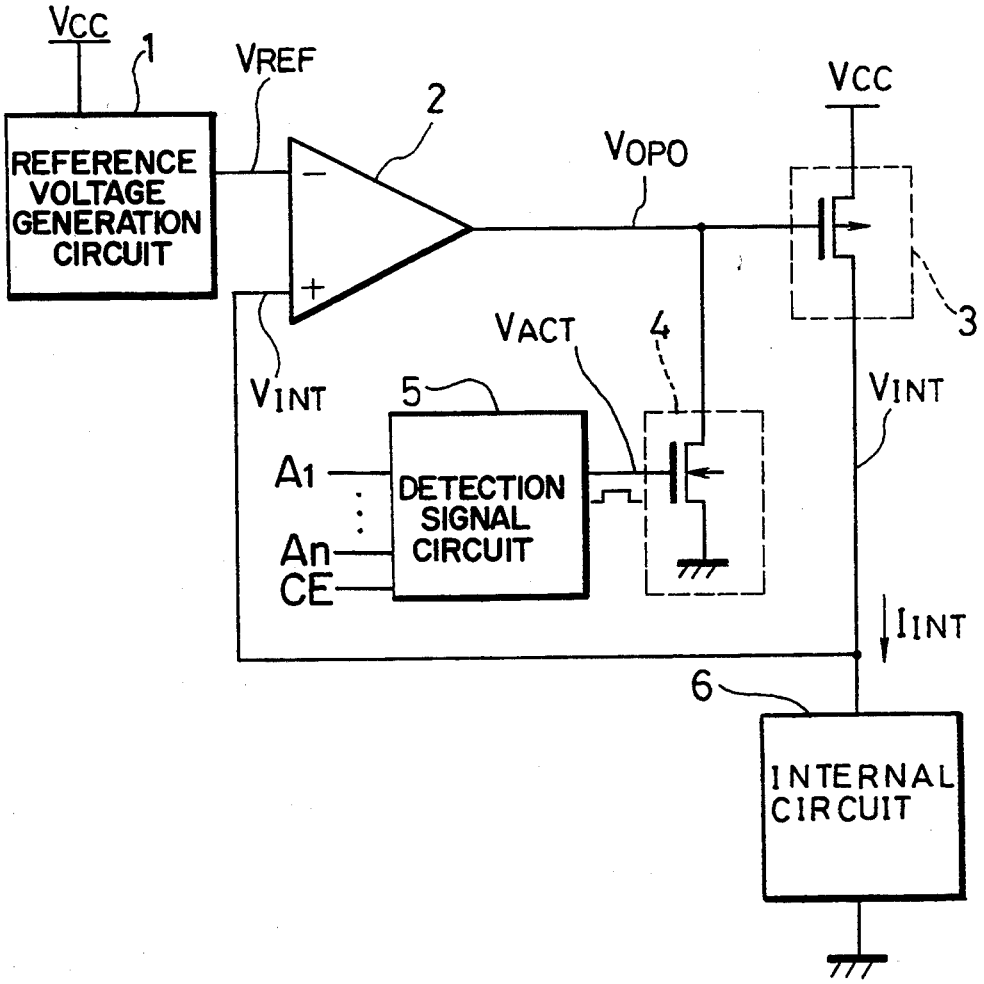
FIGS. 1 to 3, 4(*a*) and 4(*b*) show one embodiment of the present invention.

As illustrated in FIG. 1, the step-down circuit for power supply voltage of the present embodiment is constituted of: a reference voltage generation circuit 1 for generating a reference voltage $V_{REF}$ from an external power supply voltage $V_{CC}$, a differential amplification circuit 2 for receiving the reference voltage $V_{REF}$ from the reference voltage generation circuit 1 and a power supply voltage $V_{INT}$ (a first voltage) to be applied to an internal circuit 6, and a driving circuit 3 for the internal circuit 6 for controlling a driving current $I_{INT}$ to be supplied to the internal circuit 6 in response to a control signal $V_{OPO}$ from the differential amplification circuit 2. A P-channel MOSFET is employed as the driving circuit 3.

The step-down circuit for power supply voltage of the present: embodiment is further provided with: a signal generation circuit 5 for releasing an active signal $V_{ACT}$ (detection signal) by detecting an increase of consumption current in the internal circuit 6, and a switching circuit 4 (control means) for turning on the driving circuit 3 (P-channel MOSFET) for the internal circuit 6 in response to the active signal $V_{ACT}$ from the signal generation circuit 5. An N-channel MOSFET is employed as the switching circuit 4.

Figure 4:
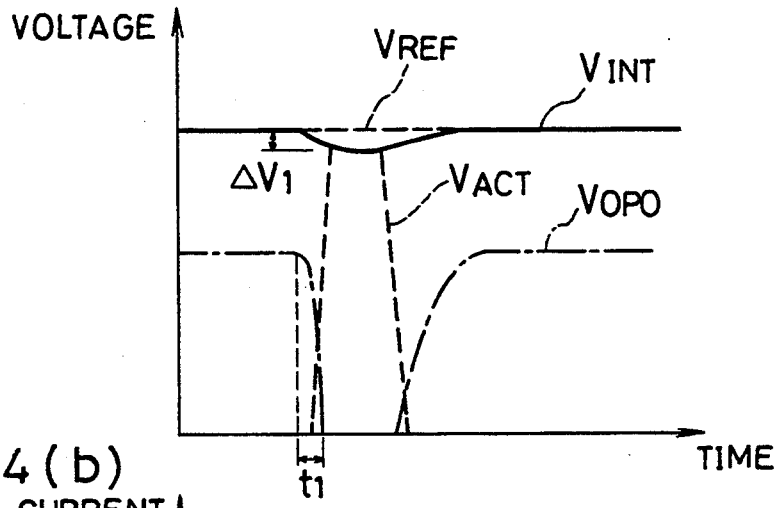
Figure 4:
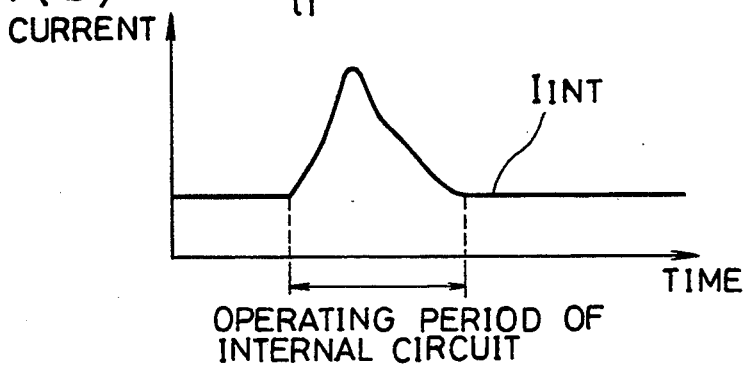
Figure 5:
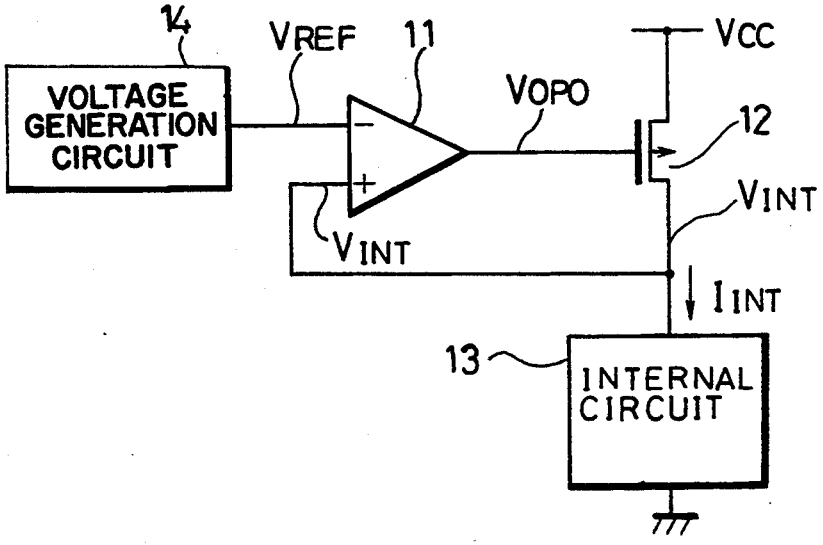
FIG. 5 PRIOR ART
FIG. 5 is a circuit diagram showing the step-down circuit for power supply voltage of the prior art.
Figure 6A:
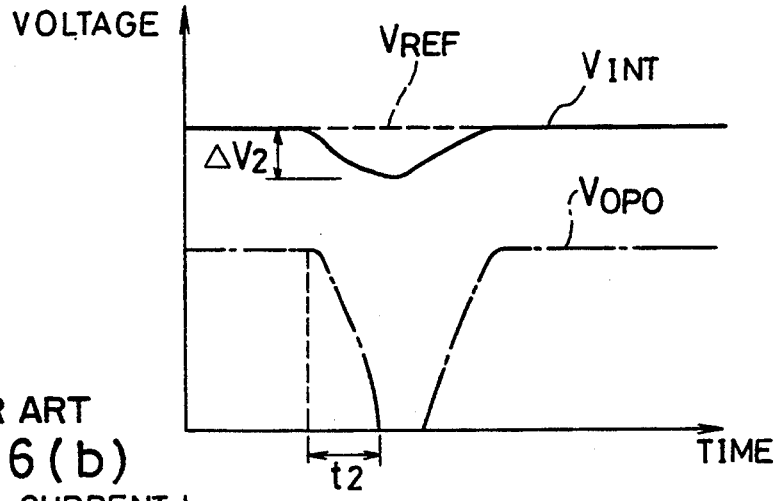
PRIOR ART FIG. 6(a)
FIG. 6(*a*) illustrates voltage waveforms in the step-down circuit for the power supply voltage of FIG. 5.
Figure 6B:
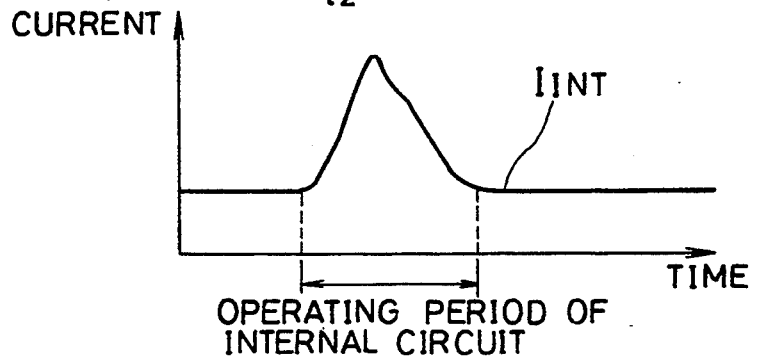
PRIOR ART FIG. 6(b)

In the above arrangement, when the internal circuit 6 is activated and the consumption current of the internal circuit subsequently increases as illustrated in FIG. 4(*b*), the power supply voltage $V_{INT}$ of the internal circuit 6 drops abruptly as illustrated in FIG. 4(*a*). Consequently, since the active signal $V_{ACT}$ from the signal generation circuit 5 goes high, the switching circuit 4 (N-MOSFET) is turned on. Therefore, the driving circuit 3 (P-MOSFET) for the internal circuit 6 is turned on. As a result, since the driving current $I_{INT}$ is supplied to the internal circuit 6, the drop of the power supply voltage $V_{INT}$ in the internal circuit 6 can be restricted to a minimum value $\Delta V_1$.

Thereafter, the active signal $V_{ACT}$ goes low. In this case, the change in the consumption current of the internal circuit 6 is small; therefore, the differential amplification circuit 2 controls the driving circuit 3 (P-MOSFET) for the internal circuit 6 so that the power supply voltage $V_{INT}$ of the internal circuit 6 becomes equivalent to the reference voltage $V_{REF}$.

As described above, the step-down circuit for power supply voltage of the present embodiment allows the switching circuit 4 (N-MOSFET) to turn on by the use of the active signal $V_{ACT}$ from the signal generation circuit 5; therefore, when the consumption current of the internal circuit 6 increases, the control signal $V_{OPO}$ released from the differential amplification circuit 2 becomes low in a short period of time (indicated by $t_1$ in FIG. 4(*a*)). Consequently, compared to the conventional step-down circuit for power supply voltage, it becomes possible to turn on the driving circuit 3 of the internal circuit 6 in a short period of time. Thus, the drop of the power supply voltage $V_{INT}$ in the internal circuit 6 can restricted to a minimum value $\Delta V_1$.

Figure 2:
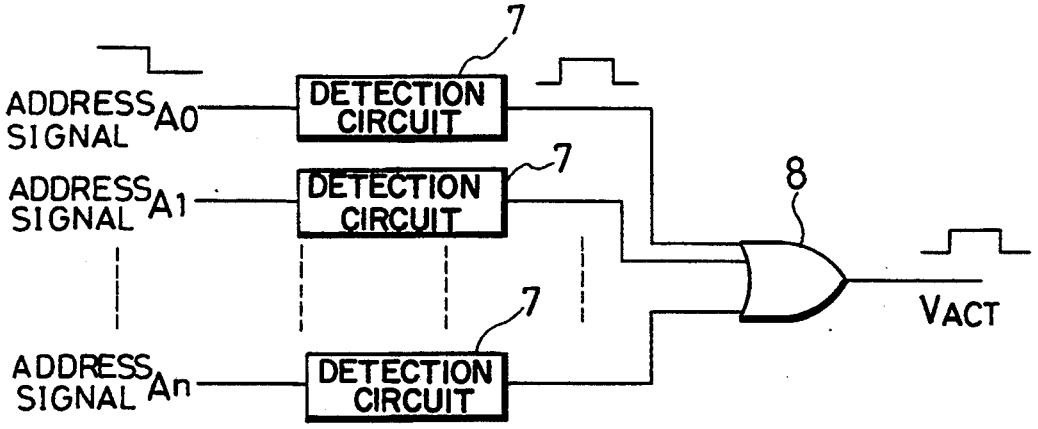

FIG. 2 shows one example of the signal generation circuit 5.

The signal generation circuit 5 is constituted of a detection circuits 7 for generating pulses by detecting changes (start of activation) of address signals $A_0, A_1, \ldots, A_n$, and an OR gate 8 for releasing a logical OR of outputs from the detection circuits 7 as the active signal $V_{ACT}$. The active signal $V_{ACT}$ is released upon receipt of changes (start of activation) in the address signals $A_0, A_1, \ldots, A_n$.

Figure 3:
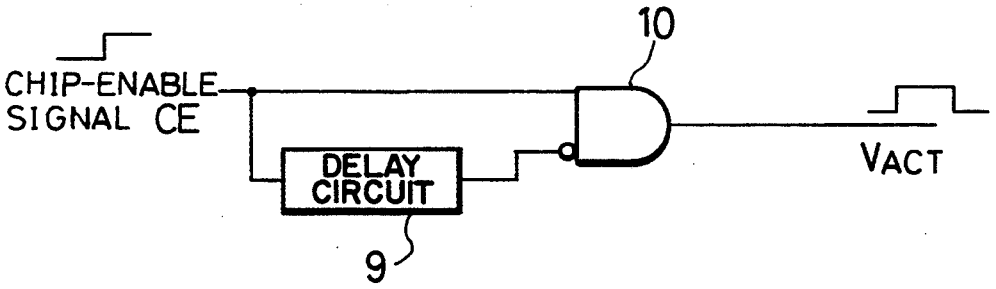

FIG. 3 shows another example of the signal generation circuit 5.

The signal generation circuit 5 is constituted of a delay circuit 9 for delaying a chip-enable signal CE and a gate 10 for releasing as the active signal $V_{ACT}$ a logical AND of the chip-enable signal CE and a NOT of the delay signal from the delay circuit 9. Here, the active signal $V_{ACT}$ is released upon activation of the chip-enable signal CE (upon release from the stand-by state).

The signal generation circuit 5 shown in FIGS. 2 and 3 is especially effective when used with the internal circuit 6 consisting of a memory such as a RAM. As the address signals $A_0, A_1, \ldots, A_n$ change, a large driving current $I_{INT}$ flows in the form of pulses. Further, when the chip-enable signal CE is activated, a small driving current $I_{INT}$ flows constantly after the large driving current $I_{INT}$ has flown in the form of pulses.

Additionally, in the signal generation circuit 5 of FIG. 2, each detection circuit 7 may be constituted of, for example, a delay circuit for delaying an address signal $A_i$ and an exclusive OR circuit for releasing an exclusive logical OR of the address signal $A_i$ and the delay signal from the delay circuit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A step-down circuit for power supply voltage, which converts an external power supply voltage into a first voltage that is lower than the external power supply voltage so as to apply it to an internal circuit, comprising:

reference voltage generation circuit means for generating a reference voltage from the external power supply voltage;

differential amplification circuit means for releasing a difference between the reference voltage and the first voltage as a control signal;

driving circuit means for controlling a driving current to be supplied to the internal circuit according to the control signal from the differential amplification circuit;

signal generation circuit means for releasing a detection signal that indicates an increase in consumption current in the internal circuit; and control means for controlling the driving circuit means so as to increase the current to be supplied to the internal circuit in accordance with the detection signal from the signal generation circuit means.

2. The step-down circuit for power supply voltage as defined in claim 1, wherein the signal generation circuit means includes:

detection circuits means for generating pulses by detecting changes in address signals for specifying addresses in the internal circuit; and an OR gate for releasing a logical OR of outputs from the detection circuits means as a detection signal.

3. The step-down circuit for power supply voltage as defined in claim 1, wherein the signal generation circuit means includes:

a delay circuit means for delaying a chip-enable signal for making the internal circuit operative; and a gate means for releasing as a detection signal a logical AND of the chip-enable signal and a NOT of a delay signal from the delay circuit.

4. The step-down circuit for power supply voltage as defined in claim 1, wherein the driving circuit means is a P-channel MOSFET and the control circuit is an N-channel MOSFET.

5. The step-down circuit for power supply voltage as defined in claim 1, where the internal circuit consists essentially of a memory.

6. A step-down circuit for power supply voltage, which converts an external power supply voltage into a first voltage that is lower than the external power supply voltage so as to apply it to an internal circuit, comprising:

reference voltage generation circuit means for generating a reference voltage from the external power supply voltage;

differential amplification circuit means for releasing a difference between the reference voltage and the first voltage as a control signal;

driving circuit means for controlling a driving current to be supplied to the internal circuit according to the control signal from the differential amplification circuit;

signal generation circuit means for releasing a detection signal that indicates an increase in consumption current in the internal circuit; and control means for controlling the driving circuit means so as to increase the current to be supplied to the internal circuit in accordance with the detection signal from the signal generation circuit means, so that the current supplied to the internal circuit is increased upon an increase in consumption of current in the internal circuit.

* * * * *